United States Patent [19]

Przybylek

[11] 3,980,366

[45] Sept. 14, 1976

[54] METHOD OF MAKING A HERMETIC SEAL THEREIN A MULTI-POSITION CHARACTER DISPLAY PANEL

[75] Inventor: George J. Przybylek, Martinsville, N.J.

[73] Assignee: Burroughs Corporation, Detroit, Mich.

[22] Filed: Jan. 31, 1975

[21] Appl. No.: 546,093

[52] U.S. Cl. ..... 316/20

[51] Int. Cl.[2] ..... H01J 9/385

[58] Field of Search ..... 316/17–20; 52/304; 53/7, 8, 9; 65/34, 43; 313/220

[56] References Cited

UNITED STATES PATENTS

| | | | |
|---|---|---|---|
| 1,398,033 | 11/1921 | Maurer | 65/34 |
| 2,032,003 | 2/1936 | Clause | 65/43 |
| 2,988,852 | 6/1961 | Henry | 65/34 |
| 3,746,420 | 7/1973 | Baker et al. | 316/20 |
| 3,799,649 | 3/1974 | Carlyle | 350/160 LC |
| 3,886,014 | 5/1975 | Bayer | 65/43 |

FOREIGN PATENTS OR APPLICATIONS

| | | | |
|---|---|---|---|
| 739,687 | 8/1966 | Canada | 52/304 |

OTHER PUBLICATIONS

B351,672, Jan. 1975, Beckerman et al., 316/20.

*Primary Examiner*—Richard B. Lazarus

*Attorney, Agent, or Firm*—Kevin R. Peterson; William B. Penn; Robert A. Green

[57] ABSTRACT

The display panel is filled with an ionizable gas and includes a base plate on which a plurality of groups of cathodes and their conductors are formed, each group of cathodes being operable to display a character. The panel also includes a face plate, spaced from the base plate, and carrying transparent conductive anodes, each associated with one group of cathodes. The base plate and face plate are hermetically sealed together by a frame of a sealing material formed from a thin layer of powdered glass in a removable carrier.

The panel is made by assembling all of the parts and sealing the envelope but including a wire in the frame of sealing material. After the seal has been formed, the wire is removed to leave a small hole providing gas communication with the interior of the panel. The panel is then placed in an oven and evacuated, baked out, and filled with the desired gas filling through the hole, after which the hole is hermetically sealed. A separate mass of sealing material may also be provided to seal the hole left by the wire.

2 Claims, 13 Drawing Figures

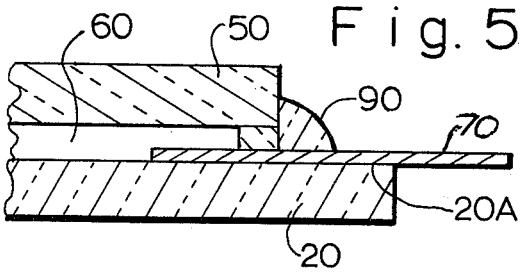
Fig. 5
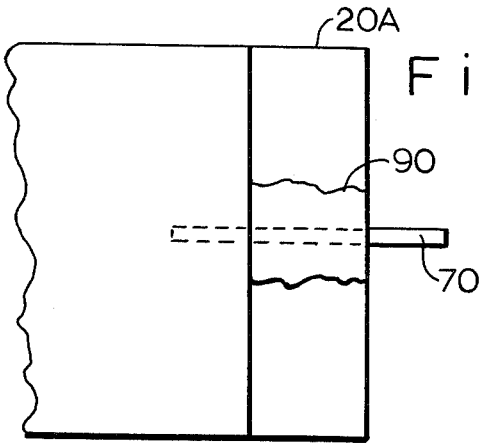
Fig. 6
Fig. 8
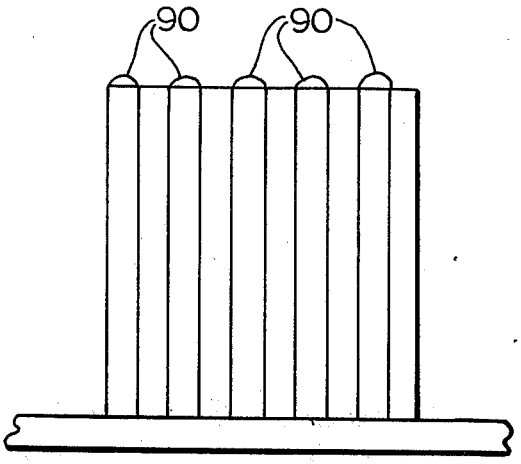
Fig. 7
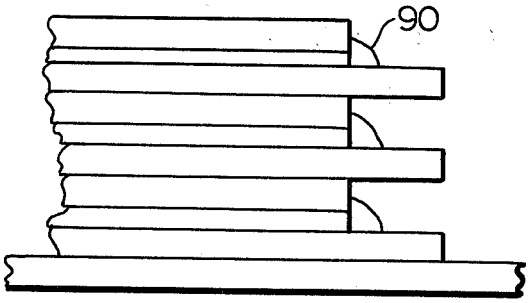
Fig. 9
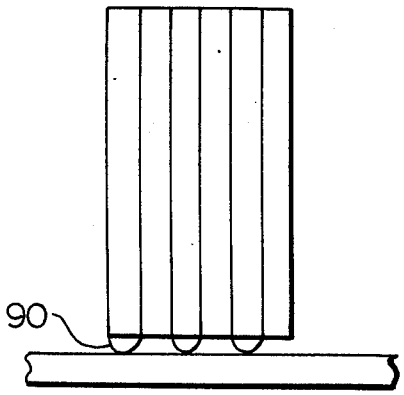

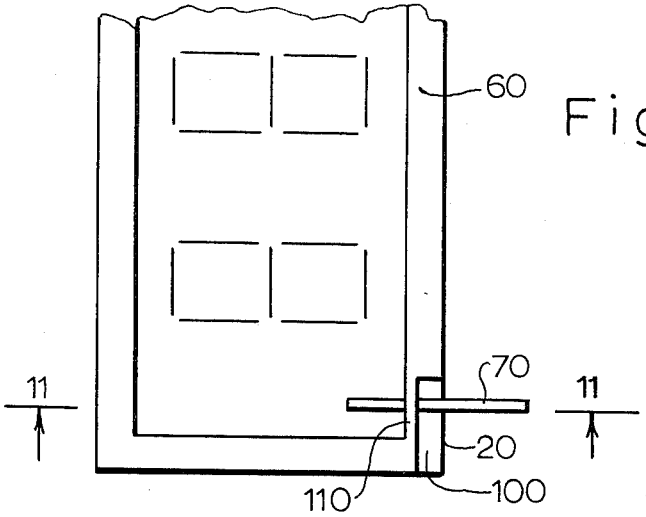
Fig. 10
Fig. 11
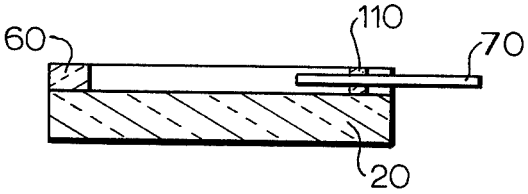
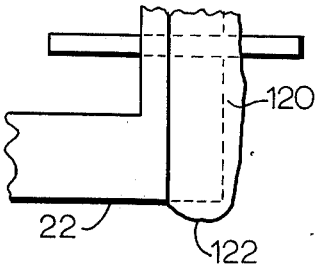
Fig. 12
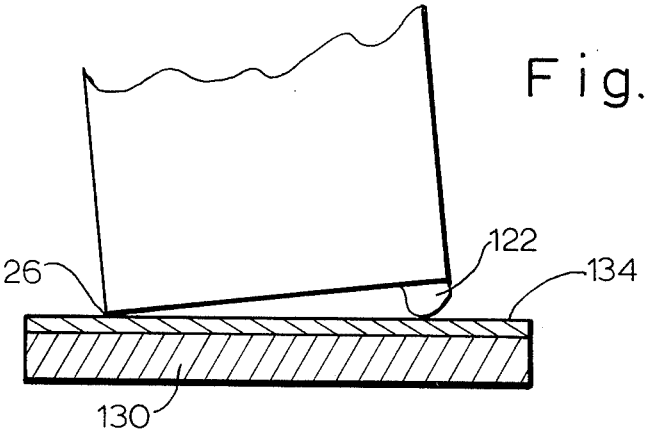
Fig. 13

METHOD OF MAKING A HERMETIC SEAL THEREIN A MULTI-POSITION CHARACTER DISPLAY PANEL

BACKGROUND OF THE INVENTION

Display panels of the type described above, known as PANAPLEX panels, have been available commercially for some time. In general, these panels are manufactured by forming the various electrodes on the base plate and face plate of the panel envelope, sealing together the base plate and face plate, baking out the envelope through a tubulation secured to the base plate, filling the envelope with the desired gas through the tubulation, etc. These processing steps are essentially all separate operations and require the panel to be handled many times and processed in different types of ovens and other apparatus.

In order to reduce costs of manufacture, it would be desirable to eliminate the tubulation and perform the majority of the processing operations in one location and with minimal apparatus. Various suggestions have been made for achieving these goals; however, none has been completely satisfactory.

SUMMARY OF THE INVENTION

Briefly, the method of the invention comprises completely assembling the display panel, but leaving a hole in the seal between the base plate and face plate, through which the panel can be baked out and filled with the desired gas. These operations are performed in an oven, and, after they are completed, the hole is hermetically sealed, in the oven, to complete the manufacture of the panel.

DESCRIPTION OF THE DRAWINGS

FIG. 5 is a sectional view of a portion of a display panel illustrating a modification of the invention;

FIG. 6 is a plan view of the apparatus of FIG. 5;

FIG. 7, 8 and 9 illustrate various orientations in which display panels may be disposed during a sealing operation embodying the invention;

FIG. 10 is a plan view of a portion of a panel illustrating another modification of the invention;

FIG. 11 is a sectional view along the lines 11—11 in FIG. 10;

FIG. 12 is an enlarged view of a portion of the panel of FIG. 10 at a particular stage in the processing thereof; and FIG. 13 illustrates the manner in which panels of the type shown in FIG. 10 are oriented during the sealing operation.

DESCRIPTION OF THE PREFERRED EMBODIMENTS

The principles of the invention are applicable to any type of device which comprises an envelope made up of plates hermetically sealed together by means of a ring or frame of sealing material where the device requires processing such as bake-out, evacuation, filling with a gas, or the like. For purposes of illustrating the principles of the invention, a PANAPLEX display panel, of the type made and sold by Burroughs Corporation, is shown schematically and in only enough detail to illustrate the invention. Specific details of such a panel are shown and described, for example, in U.S. Pat. 3,787,940, and, as already noted, the principles of the invention can be used to manufacture other types of devices.

Figure 1:
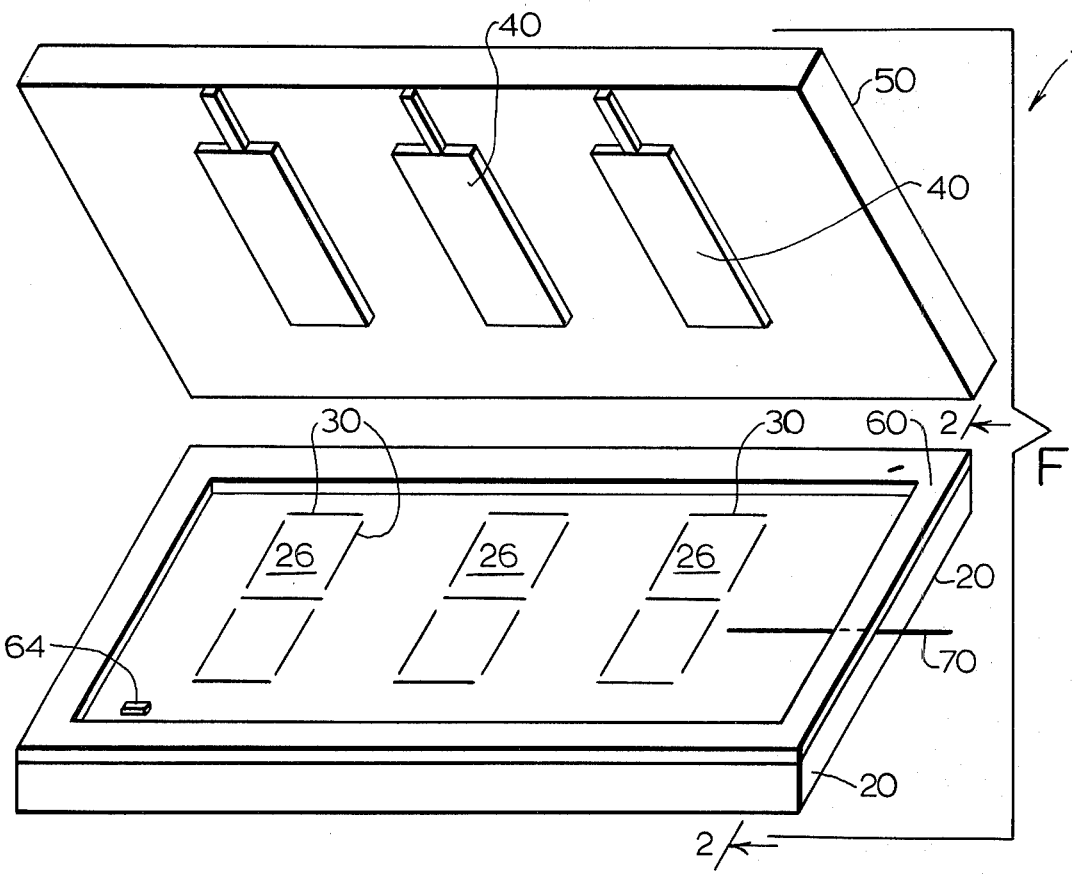
FIG. 1 is a perspective exploded view of a display panel embodying the invention.
Figure 2:
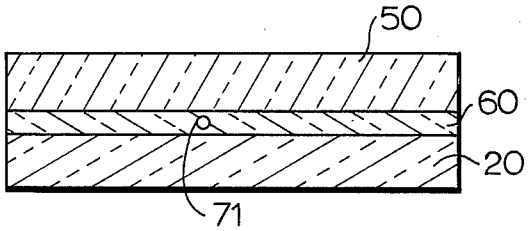
FIG. 2 is a sectional view along the lines 2—2 in FIG. 1 but showing the parts of the panel assembled.

Referring to the drawings and to FIGS. 1 and 2, a display panel 10 emboding the invention includes a base plate 20 of glass, ceramic, or the like, which carries a plurality of groups of cathode electrodes 30 in the form of segments, shown schematically, which are adapted to be energized in different combinations to display characters, as is well known in the art. The base plate also carries leads for the cathode electrodes and suitble insulating means as required; however, these are not shown, to simplify the drawings. The panel 10 also includes an anode electrode 40 for each group of cathode electrodes, and, in one arrangement, the anodes comprise thin films of conductive material, such as tin oxide, formed on the lower surface of the face plate 50. A glass or metal mercury capsule 64 may also be provided within the panel.

According to the invention, the panel 10 is manufactured as follows. First, the cathodes 30 and their leads (not shown), and anodes 40, are formed on the base plate and face plate, respectively, in any suitable manner. Screen printing processes are particularly sitable for preparing the elements formed on the base plate 20. Capsule 64 may also be seated on the base plate. Next, a frame or ring 60 of sealing material, such as a glass frit in a suitable binder is formed around the periphery of either the base plate or the face plate, or both, preferably by a screen printing process. A wire 70, about 10 to 20 mils in diameter, is embedded in the sealing ring while it is still soft, and with the base plate and face plate suitably coupled together, the assembly is passed through an oven to form an hermetic seal between the base plate and face plate. The wire 70 is then removed to leave a hole 71 (FIG. 2) in the sealing ring, and the panel is placed in an oven where it is baked out and exhausted to remove "impurities" through the hole 70 in the sealing ring 60 and then, while in the oven, the panel is filled with the desired gas filling such as argon, neon, xenon, or the like, singly or in combination, at the desired pressure. When this has been completed, the oven is raised to the appropriate temperature, and the seal material is melted to reflow the hole 71 and to form an hermetic seal and thus completely seal the panel. At a suitable time in the procedure, the mercury capsule 64 can be opened by a laser to permit mercury vapor to enter the panel.

It is noted that the foregoing method in which the seal material is heated to reflow hole 71 is particularly suitable where the sealing material is a vitreous frit.

Figure 3:
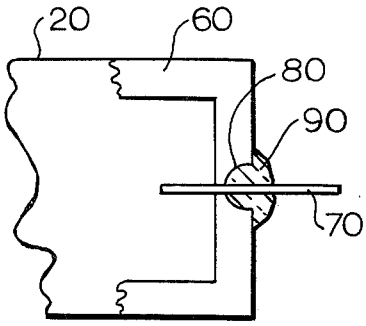
FIG. 3 is a sectional view of a portion of the panel of FIG. 1, illustrating a modification of the invention.
Figure 4:
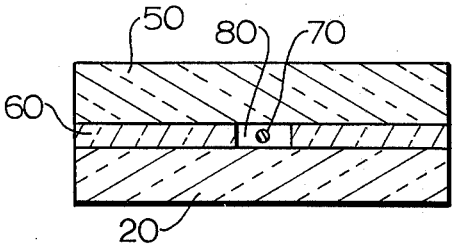
FIG. 4 is a sectional view, similar to that of FIG. 2, showing a portion of the panel illustrated in FIG. 3.

In a modification of the invention illustrated in FIGS. 3 and 4, the sealing ring 60 is provided with a notch or depression 80 which extends inwardly from an end of the panel. Again, wire 70 is set into the ring while the ring is soft, the wire lying across the depression or notch 80, and, as described above, the face plate and base plate are placed together, and the assembly is passed through an oven to form an hermetic seal. Next, a quantity 90 of glass frit is placed in the depression 80 to fill the depression, and it is heated to remove binders and to glaze the glass frit material therein, As above, the wire 70 is now removed, and the tube is processed to completion. After the panel is filled with the desired gas in the oven, it is raised to a temperature at which the added glass body 90 is melted and hermetically seals the opening 71 where the wire has been.

Under some circumstances, the formation of the final seal which fills hole 71 can be improved if the base plate 20 of the envelope extends beyond the sealing ring 60 and the face plate 50, as illustrated in FIGS. 5 and 6. In this case, the depression 80 may or may not be provided in the sealing ring 60, and the mass 90 of sealing material for hole 71 is supported on the protruding edge 20A of bae plate 20.

In processing panels according to the invention, the panels can be stacked one upon another, on a suitable carrier, and disposed horizontally as illustrated in FIG. 7, or they may be disposed vertically as illustrated in FIG. 8 with the hole 70 and mass 90 up and as illustrated in FIG. 9 with the hole 70 and mass 90 down.

In another modification of the invention illustrated in FIGS. 10 to 13, the sealing frame 60 formed on the base plate 20 has a notch 100 formed therein at one corner of the face plate. The sealing frame thus formed includes a portion 110 of reduced width which is parallel to one of the long sides of the panel and in which the wire 70 is seated. The wire 70 is thus disposed generally parallel to one end, the left or right end, of the panel and protrudes through one of the long edges of the panel, either the upper edge or lower edge. The face plate 50 of the panel is hermetically sealed to the base plate by frame 60, as described above, and then a mass 120 of sealing frit such as Pyroceram is inserted between the face plate and base plate 20, covering the portion thereof exposed by the notch or cut-out portion 100 in the sealing frame and enclosing the wire 70. A portion 122 of mass 120 projects below the end 22 of the panel. As described above, the mass of Pyroceram is heated to remove binders and to form a glaze, and the wire 70 is removed to leave hole 71 in the mass of Pyroceram and the sealing frame.

Panel assemblies thus formed are then stacked on a suitable carrier or jig 130, with the ends 22 down so that one corner 26 of the panel rests on the support 130 and the portion 122 of the mass of Pyroceram also rests on the support. The support 130 itself may be coated with a sheet or layer 34 of aluminum foil, mica matte, or the like, to which the Pyroceram will not adhere, or which may be readily removed from the Pyroceram at the end of the processing cycle. With the panels thus positioned on the jig 130 and with the jig disposed within an oven, the panels are baked out and filled with the desired gas, and then the oven is raised to a temperature of the order of 450° C., at which the Pyroceram mass 120 melts, fills the hole 71, and devitrifies to form the desired hermetic seal. The weight of the panel on the Pyroceram mass 120 assists the formation of the desired hermetic seal filling hole 71 and the space between face plate and base plate.

The method described with respect to the device shown in FIG. 1 is particularly suitable where the sealing material is a vitreous frit, and the method described with respect to the devices shown in the other Figures is particularly suitable where the sealing ring 60 and mass 90 and 120 include a devitrified glass frit of the type found in Pyroceram. In the latter case, the initial heating and glazing operation is performed at about 375° C. and the final heating is at about 450° C. In the preferred arrangement, at the present state of the art, Pyroceram is preferred for the sealing frame 60 and the auxiliary masses 90 and 120.

What is claimed is:

1. Method of making an hermetically sealed gas-filled display panel comrising the steps of preparing a base plate and face plate which are to be sealed together along their aligned perimeters to form an envelope, with electrodes included in said envelope, providing a frame of sealing material between said base plate and face plate along said aligned perimeters, embedding a non-deformable wire in said frame of sealing material, hermetically sealing together said base and face plate by heating said frame of sealing material to form said envelope with said wire extending through said seal from the inside to the outside of said envelope, providing an auxiliary mass of sealing material adjacent to said frame of sealing material and enclosing said wire where it exists from said frame, heating said auxiliary mass to remove binders therefrom, removing said wire to leave a hole in said seal and in said auxiliary mass to provide gas communication between the inside and outside of said envelope, evacuating and baking out said envelope, and filling said envelope with a gas, and hermetically sealing said hole, by heating said auxiliary mass, to form a complete hermetic seal between said plates.

2. The method of claim 1 wherein said steps of evacuating, baking out, and filling said envelope, and hermetically sealing said hole are performed in an oven.

* * * * *